United States Patent [19]

Yoneyama

[11] Patent Number: 4,575,084

[45] Date of Patent: Mar. 11, 1986

[54] BADMINTON RACKET HAVING NOVEL THROAT CONNECTION

[75] Inventor: Minoru Yoneyama, Niigata, Japan

[73] Assignee: Yonex Kabushiki Kaisha, Niigata, Japan

[21] Appl. No.: 628,629

[22] Filed: Jul. 6, 1984

[30] Foreign Application Priority Data

Dec. 16, 1983 [JP] Japan ..... 58-192849[U]

[51] Int. Cl.[4] ..... A63B 49/02

[52] U.S. Cl. ..... 273/73 G; 273/DIG. 8; 273/DIG. 23

[58] Field of Search ..... 273/73 R, 73 C, 73 D, 273/73 H, 73 J; 280/281 R; 296/205; 74/548, 551.4; 43/11, 12; 403/174, 178, 205, 346, 347

[56] References Cited

U.S. PATENT DOCUMENTS 3,151,212 9/1964 Rogers ..... 403/206
4,114,880 9/1978 Cecka ..... 273/73 G
4,119,313 10/1978 Popplewell et al. ..... 273/73 G
4,360,202 11/1982 Lo ..... 273/73 G

FOREIGN PATENT DOCUMENTS 2026327 2/1980 United Kingdom ..... 273/73 G
2076295 12/1981 United Kingdom ..... 273/73 G

*Primary Examiner*—Richard C. Pinkham
*Assistant Examiner*—Matthew L. Schneider
*Attorney, Agent, or Firm*—Wenderoth, Lind & Ponack

[57] ABSTRACT

A badminton racket comprises a tubular shaft and an oval shaped frame internally connected to the shaft by a T-shaped joint including a pair of horizontal extensions and a vertical extension. The frame has opposite end portions with opened end faces, each of which is recessed at the lower side thereof in a semi-circular shape, and abutted against each other except at the recessed portions. The horizontal extensions of the joint are fitted in the end portions of the frame while the vertical extension is fitted in the upper end of the shaft. The junction area of the racket is coated with FRP layers to provide external connection.

7 Claims, 12 Drawing Figures

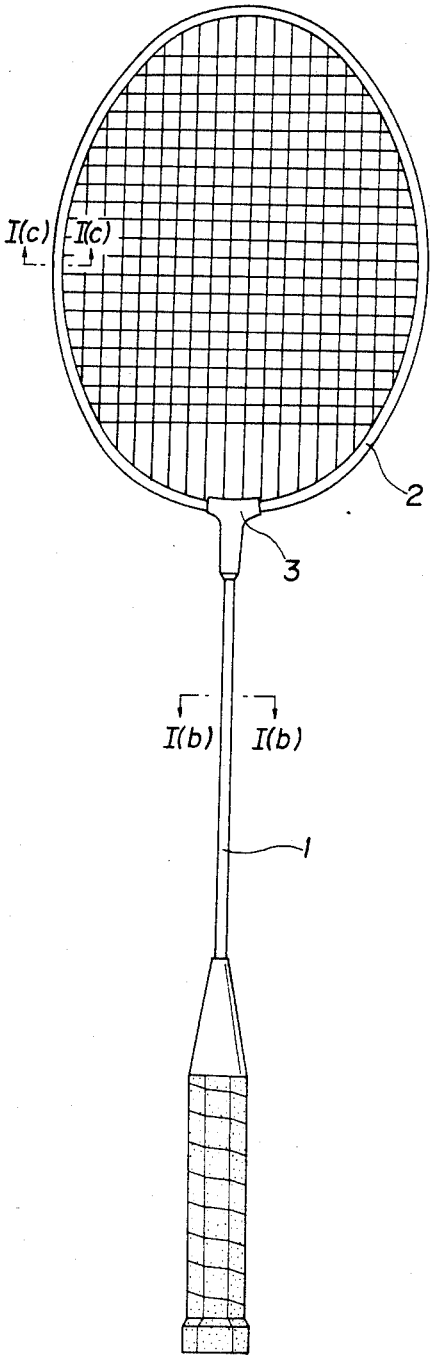
FIG. 1 (a)
PRIOR ART
FIG. 1 (b)
PRIOR ART
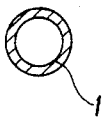
FIG. 1 (c)
PRIOR ART
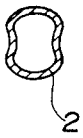

FIG. 3(a)
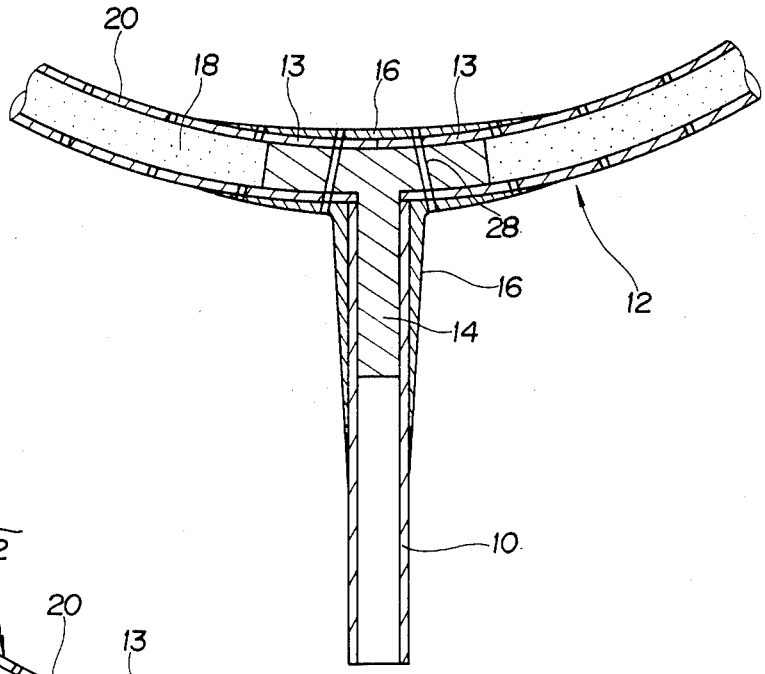
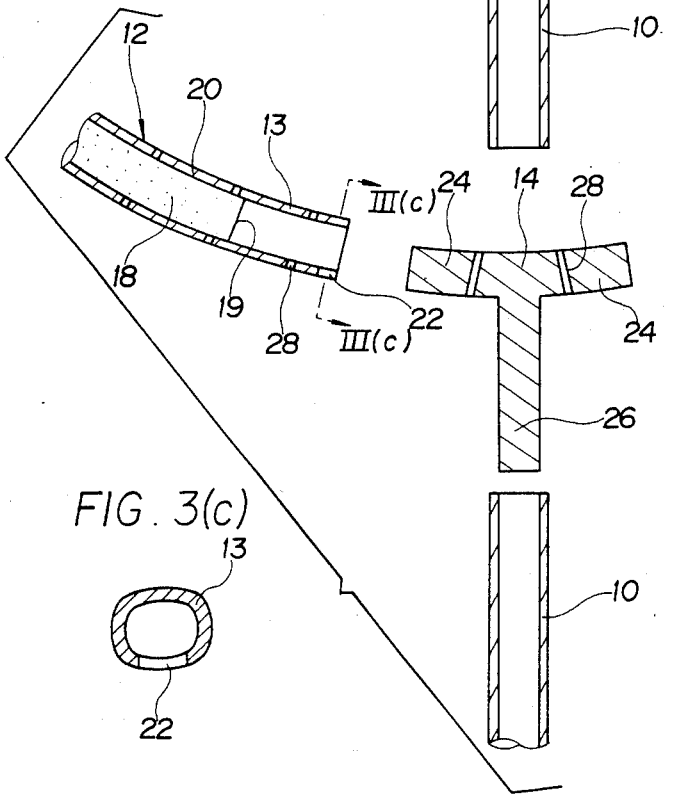
FIG. 3(b)
FIG. 3(c)

BADMINTON RACKET HAVING NOVEL THROAT CONNECTION

BACKGROUND OF THE INVENTION

This invention relates to a badminton racket.

Badminton players generally are required to carry-out more nimble, high-speed swing actions to bat a shuttle cock at short intervals in a relatively small court space compared with, for example, the game of tennis. This nimbleness and speediness is the very characteristic of the badminton game. Therefore, it becomes necessary for the badminton racket to be so constructed as to satisfy the players' nimble and high-speed actions. To this end, the badminton racket is required to be light in weight and have satisfactory resilience for easy handling. Furthermore, in order to satisfy the need for a high-speed swing action which is the most important feature of the badminton game, the dimensions of the badminton racket in the swing direction must be minimized. In other words, air resistance must be minimized as much as possible. At the same time, it is necessary to provide the racket with a high mechanical strength in order withstand the stress of a high-speed swing as well as various impact loads arising from the use of the racket. Although these are all indispensable factors for a good badminton racket to possess, it is very difficult to fulfil all of them simultaneously, since some of them are incompatible with others. For example, light weight, desirable resilience and minimum air resistance may all be provided together in the badminton racket, but all these factors result in the reduction of the mechanical strength thereof. Unless a good balancing of the incompatible factors can be provided, any other improvement in the structure of the badminton racket would be meaningless.

In order to satisfy the foregoing requisites as much as possible, the badminton racket has been carefully designed to take its present style and structure. That is, the badminton racket has taken completely different historical steps of development from other similar rackets, such as a tennis racket, designed to hit a heavier ball. At present, as shown in FIGS. 1 (*a*), 1 (*b*) and 1 (*c*), a badminton racket formed of a rigid tubular shaft 1 and a tubular frame 2 connected with each other by a tubular joint 3 of substantially T-shaped configuration represents the main stream of badminton racket design. The badminton racket of this type has the frame 2 made of a tubular material having light and resilient properties such as, for example, fiber reinforced plastic (hereinafter referred to as "FRP"), stainless steel or aluminum, and connected to the shaft 1 by means of the T-shaped tubular joint 3 as shown in FIG. 1 (*a*). The shaft 1 is constructed of tubing of circular cross section as shown in FIG. 1 (*b*), while the frame 2 is of tubing of irregularly rounded cross section, as shown in FIG. 1 (*c*), having a major axis thereof disposed in the swing direction which is perdendicular to the racket face. This conventional badminton racket is thus constructed with a view to achieving high mechanical strength to meet the requirements of a high-speed swing, in addition to light weight, reduced air resistance and satisfactory resilience.

A badminton racket with the above structure has been considered to be very close to an ideal style until recently. However, actually, there remained a number of problems yet to be solved. Firstly, with such badminton racket, the above mentioned T-shaped joint portion is inherently required to be constructed with larger dimensions than the other racket portions. Specifically, with such conventional badminton racket, the tubular joint 3 is adapted to connect frame 2 and shaft 1 and is formed substantially in a T-shaped configuration having portions 3*a*—3*a* and 3*b* in which terminal ends 2*a*—2*a* of the frame 2 and the upper end 1*a* of the shaft 1 are fixedly inserted, respectively, as shown in FIGS. 2 (*a*) to 2 (*c*). However, since the outer diameter of this joint portion 3 is much larger than those of the shaft 1 and the frame 2, air resistance becomes much larger. The air resistance applied to the joint portion 3 has been a large obstacle for reducing the air resistance of the racket as a whole. To be worse, the present inventor learned that, since the joint 3 forms a pivotal portion at which various loads arising from the swing of the badminton racket are structurely concentrated, any effort to minimize air resistance by decreasing the size and thickness of portions 3*a*, 3*b*, will lead to a decrease of the mechanical strength of such pivotal portion. Because of the reasons set forth above, a sufficiently large size and thickness of the joint portion 3 had to be maintained, even at the sacrifice of the requirement to decrease the air resistance.

Furthermore, the tubular T-shaped joint 3 is found to be a large obstacle to achieving desired resilience of the badminton racket. In other words, since the joint 3 is a pivotal portion for joining the frame 2 and the shaft 1, it is required to be of sufficient mechanical strength, while the provision of such mechanical strength of tubular joint 3 may prevent the badminton racket from having satisfactory resilience. When the mechanical strength of the joint 3 is increased while maintaining satisfactory resilience of the racket, the shaft 1 and the frame 2 will be subject to material fatigue, primarily at portions thereof adjacent the end portions 3*a*, 3*b* of the T-shaped tubular joint 3, due to the concentration of various impact loads resulted from the difference in rigidity and resilience therebetween. This will result in easy breakage of the shaft and the frame at such portions.

As mentioned in the foregoing, in the conventional badminton racket, there are too many factors which are incompatible with each other, although they are very important for a desirable function of the badminton racket shown. The conventional badminton racket in FIGS. 1 (*a*) through 2 (*c*) cannot satisfy all these factors, i.e., high mechanical strength, minimum air resistance and desirable resilience, simultaneously.

SUMMARY OF THE INVENTION

The present invention has been developed in view of the above problems. The purpose of the present invention therefore is to overcome those problems which were considered to be incompatible with each other with respect to conventional badminton rackets, while maintaining good balancing thereof. More particularly, an object of the present invention is to provide a badminton racket in which the junction area between a shaft and a frame may be of minimum dimensions thereby to reduce air resistance applied thereto.

Another object of the present invention is to provide a badminton racket which has a desirable resilience as well as a sufficient mechanical strength.

A further object of the present invention is to provide a badminton racket whereby it is possible to decrease fatigue of the material of the shaft and frame, thereby to improve the durability of the racket.

According to the present invention, there is provided a badminton racket which comprises a tubular shaft having a hollow upper end, an oval-shaped tubular frame having oppsite end portions, each end portion being hollow with an opened end face, each end face having at its lower side a recess of generally semi-circular shape, the end faces being substantially abutted against each other except at the recesses, a generally T-shaped joint having a pair of horizontal extensions and a vertical extension, the horizontal extensions being fixedly inserted into the end portions of the frame, while the vertical extension is fixedly inserted into said upper end of the shaft, thereby to internally connect the frame to the shaft, and fiber reinforced plastic layers coating the outer surface of the end portions of the frame and the upper end of the shaft to provide an external connection therebetween.

Other objects, features and advantages of the present invention will be apparent from the following detailed description thereof when taken in conjunction with the accompanying drawings, in which:

BRIEF DESCRIPTION OF THE DRAWINGS

FIG. 1 (*a*) is a front elevation of a conventional badminton racket;

FIG. 1 (*b*) is a sectional view taken along line I (*b*)—I (*b*) in FIG. 1 (*a*);

FIG. 1 (*c*) is a sectional view taken along line I (*c*)—I (*c*) in FIG. 1 (*a*);

FIG. 2 shows details of a T-shaped joint connecting a frame and a shaft shown in FIG. 1, and wherein;

FIG. 2 (*a*) is an enlarged front elevation of the T-shaped joint;

FIG. 2 (*b*) is a sectional view taken along line II (*b*)—II (*b*) in FIG. 2 (*a*);

FIG. 2 (*c*) is a sectional view taken along line II (*c*)—II (*c*) in FIG. 2 (*a*);

FIG. 3 (*a*) is a front sectional view showing a main portion of a badminton racket according to a first embodiment of the present invention;

FIG. 3 (*b*) is an exploded view of the structure shown in FIG. 3 (*a*);

FIG. 3 (*c*) is a sectional view taken along line III (*c*)—III (*c*) in FIG. 3 (*a*);

DETAILED DESCRIPTION OF THE INVENTION

Figure 2:
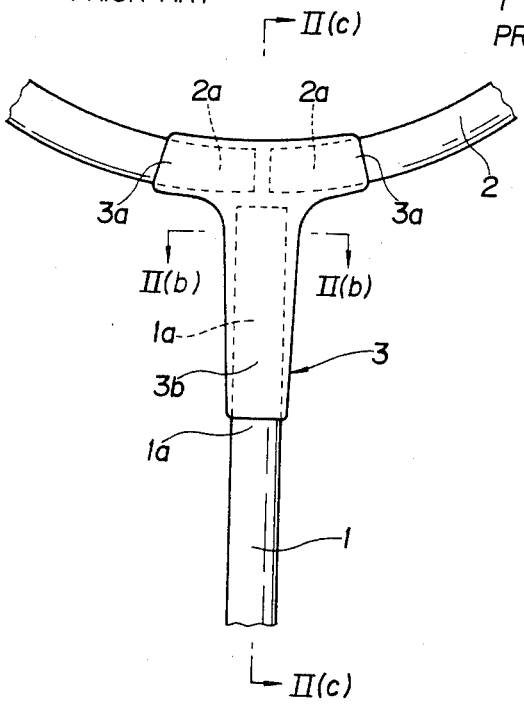
FIG. 2 (a) PRIOR ART
Figure 2:
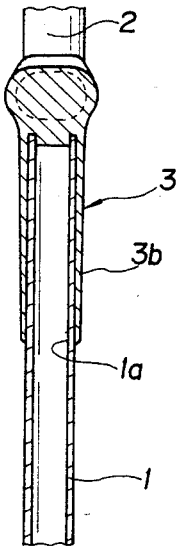
FIG. 2 (c) PRIOR ART
Figure 2:
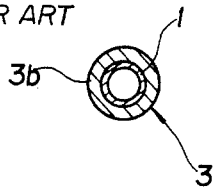
FIG. 2 (b) PRIOR ART

Preferred embodiments of the present invention will be described hereunder with reference to the accompanying drawings, wherein like numerals denote like or corresponding parts throughout.

Referring to a first embodiment of the present invention as shown in FIGS. 3 (*a*) to 3 (*c*) wherein the main portion of the badminton racket is shown, the badminton racket comprises a tubular shaft 10 of circular cross section, a frame 12 of irregularly rounded cross section having a major axis thereof disposed in the swing direction, a substantially T-shaped joint 14 connecting the shaft 10 and the frame 12, and FRP layers 16. The shaft 10 and the frame 12 may be made of stainless steel, aluminum, FRP or other materials, but preferably they are made of carbon fiber reinforced plastic material. The frame 12 in the illustrated embodiment includes a core 18 made of foamed urethane and covered with the FRP structure 20. In manufacturing this particular frame 12, non-foamed urethane is covered with the carbon FRP in a prepreg state and these are placed in a molding die having a cavity of a shape corresponding to a predetermined configuration of the frame 12. When the molding die is heated, the FRP is urgedly pressed against the internal walls defining the cavity by foaming or expanding of the core material.

The core 18 terminates at 19 and the FRP 20 extends beyond the ends of the core 18 to form hollow end portions 13—13 for completing and closing the substantially oval shape of the frame 12. Each end portion 13 receives therein a horizontal extension 24 of the T-shaped joint 14, the horizontal extension having a length sufficient to reach the end 19 of the core 18 and being formed to elliptical configuration with a dimension equal to or slightly smaller than the inner dimension of the hollow end portion 13. A vertical extension 26 of the joint 14 has a circular shape of a diameter equal to or slightly smaller than the inner diameter of the shaft 10 to ensure the insertion of the extension 26 into the upper portion of the shaft 10. Each of the end faces of the end portions 13 is provided at its lower side with a recess 22 of a semi-circular shape as shown in FIG. 3 (*c*), thereby to allow the vertical extension 26 of the joint 14 to be fitted in the shaft 10. Thus, a part of the vertical extension 26 just below the junction area of the joint 14 is received by and rested in the coupled recesses 22 defining the circular opening, while the remaining edges or end faces of the portions 13 are substantially abutted with each other to define the closed space within the frame 12.

The joint 14 may be made of metallic material such as, for example, aluminum which is light in weight and has a high mechanical strength. If this particular material is employed, manufacture of the joint 14 is preferably carried out by die casting techniques. Alternatively, the joint 14 may be formed of FRP of which the reinforcing member is desirably carbon fiber or a composite of carbon fiber and boron fiber, those fibers being suitable due to the superior characters such as high strength per weight. It is also preferable that the joint 14 be formed in a solid state, an advantage thereof being described later.

The FRP layers 16 are laminations of relatively thin sheets which comprise carbon fibers impregnated with thermosetting resin material. In assembling the racket, the shaft 10 and the frame 12 are internally connected with each other by the T-shaped joint 14, and the upper portion of the shaft 10 and the end portions 13 of the frame 12 are covered with the FRP sheets in a prepreg state. Thereafter, the prepreg sheets are hardened by application of the heat, thus forming the FRP layers 16 which provide a smooth external joining of the shaft 10 and the frame 12, as shown in FIG. 3 (*a*). The upper edge of the shaft substantially abuts on the lower surface of the frame 12 at portions adjacent the recesses 22.

In the drawings, numeral 28 denotes a hole for an eyelet for securing a gut. In the junction area, the hole 28 is defined through the joint 14, the frame 12 and the FRP layers 16. The joint 14 formed in a solid state can maintain a sufficiently high mechanical strength in spite of the holes 28 defined therein.

Figure 4:
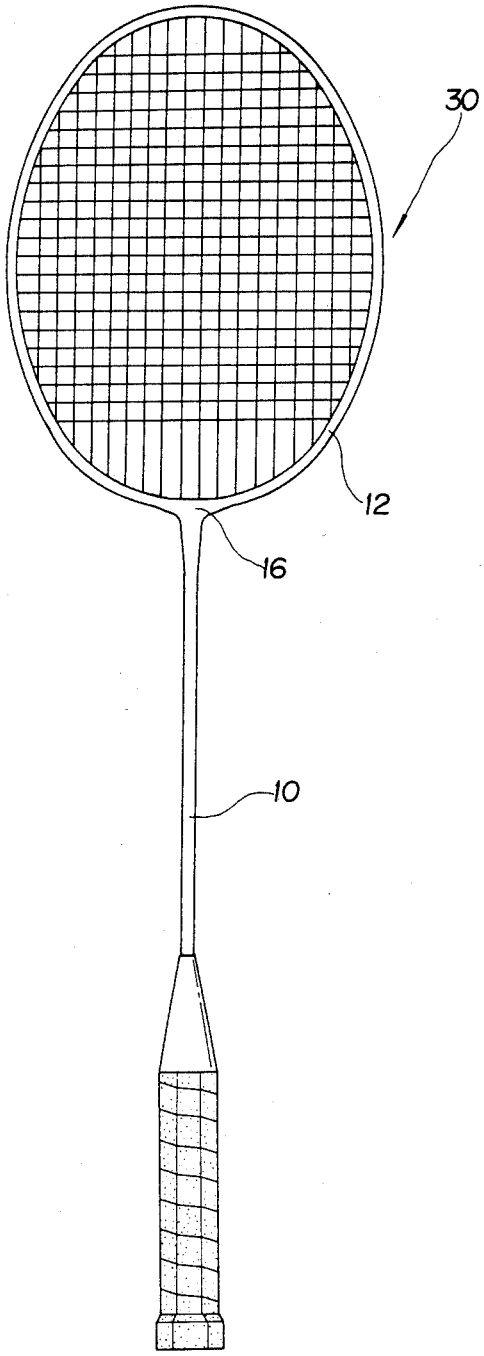
FIG. 4 is a front elevation of the present badminton racket showing the external configuration thereof.

As will be understood from the above description, the joint 14 mounted and secured inside of the shaft 10 and the frame 12 enables the junction area to have substantially the same dimension as that of the other portions of the racket 30, and a completely integral appearance can be obtained as shown in FIG. 4. Therefore, the air resistance at the junction area in the swing direction can be greatly reduced compared with the conventional badminton racket of the type as mentioned above. At the same time, since the T-shaped joint 14 and the FRP layers 16 cooperate with each other to enhance the joining strength between the shaft 10 and the frame 12 from both outside and inside thereof, a stable connection with a sufficiently high mechanical strength can be obtained without increasing the dimensions of the junction area.

Furthermore, since the T-shaped joint 14 is inserted into the interiors of the respective pipings of the frame 12 and the shaft 10, the joint 14 can be bent or twisted by a smaller amount in accordance with the bending and twisting of the frame 12 and the shaft 10. On the other hand, the external connection which is required to have more bending and twisting properties is formed of the FRP layers 16 having comparatively high flexibility and resilience as mentioned above. Therefore, the external connection can be bent and twisted in accordance with the bending and twisting of the frame 12 and the shaft 10 without any difficulty. This prevents fatigue of the material of the shaft 10 and the frame 12 even if these elements are formed to have satisfactory flexibility and resilience. In addition, since both end faces of the end portions 13—13 of the frame 12 are in contact with each other except at the recesses 22—22, the junction area completely has a three-layer-structure comprising the internal T-shaped joint 14, the frame 12 (or the shaft 10) and the external joint 16 of FRP layers, thereby increasing the mechanical strength of the badminton racket. To abut the end faces of the frame 12, that is, to close the frame 12, also reduces the fatigue of the frame 12 due to the decreased loads which the joint 14 and the FRP layer 16 have to withstand. Thus, in the badminton racket 30, the important factors therefor such as mechanical strength, minimum air resistance and satisfactory resilience no longer are incompatible with each other.

Figure 5:
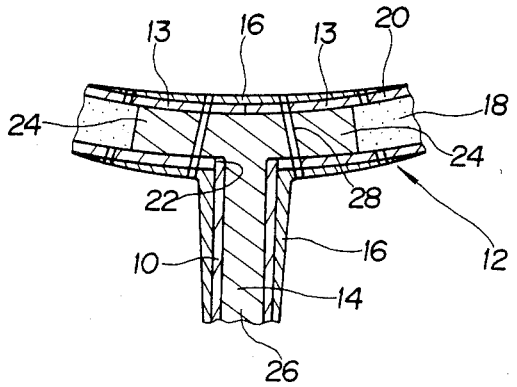
FIG. 5 is a sectional view showing a main portion of a badminton racket according to a second embodiment of the present invention.

Reference is now made to a second embodiment of the present invention as illustrated in FIG. 5. In this embodiment, the end portions 13 of the frame 12 have recesses 22 of semi-circular shape, but the diameters of which are larger than that of the first embodiment. The vertical extension 26 of the T-shaped joint 14 is entirely fitted within the shaft 10 which in turn extends into the recesses 22 to substantially abut directly on the horizontal sections 24 of the joint 14. Other structures and features of the second embodiment are substantially the same as in the first embodiment.

Figure 6:
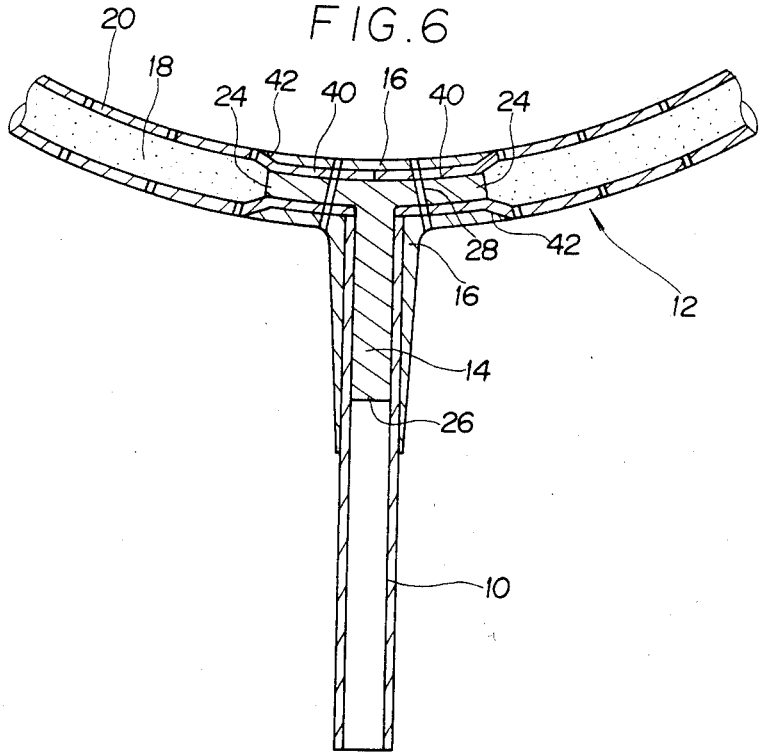
FIG. 6 is a similar sectional view of a badminton racket according to a third embodiment of the present invention.

FIG. 6 illustrates the main portion of a badminton racket according to a third embodiment of the invention. The frame 12 of this embodiment includes opposite end portions 40—40 which are defined by inclined steps 42—42 and have a diameter smaller than the remaining portion of the frame 12. The horizontal extensions 24 of the joint 14 also have smaller dimensions to fit within the end portions 40. The outer surfaces of the end portions 40 are covered with the FRP layers 16 in such a manner that the horizontal section of the junction area has substantially the same dimension as the frame 12. This makes it possible to further reduce the air resistance.

In the illustrated embodiments, the frame 12 is formed of carbon fiber reinforced plastic material. However, it should be noted that the material for the frame 12, as well as for the shaft 10, is not limited to such particular material and that other FRP material and metalic material such as aluminum may be employed. Also, the T-shaped joint 14 may be made of metalic material such as aluminum, or FRP materal. If a carbon FRP joint is used and the same material is employed for the shaft 10 and the frame 12, "feel" of the badminton racket is improved.

As described in the foregoing, the badminton racket according to the present invention has the charateristics of sufficiently high mechanical strength, minimum air resistance, and satisfactory resilience simultaneously without sacrificing any one of them, although these factors were considered to be incompatible with each other with respect to conventional badminton rackets. Furthermore, since the outer configuration of the badminton racket does not include any stepped surfaces or extruded portions, a desirable design effect can be achieved, and at the same time, the aerodynamic properties when the badminton racket is swung at a high speed are enhanced which enables an excellent handling of the badminton racket.

Although the present invention has been described with reference to the preferred embodiments thereof, many modifications and alterations may be made within the spirit of the present invention.

What is claimed is:

1. A badminton racket comprising:

a tubular shaft having a hollow upper end;

an oval-shaped tubular frame having opposite end portions, each said end portion being hollow with an opened end face and being formed smaller in dimension than the remaining portion of said frame, each said end face having at its lower side a recess of generally semi-circular shape, and said end faces being substantially abutted against each other except at said recesses;

a joint of substantially T-shaped configuration having a pair of horizontal extensions and a vertical extension, said horizontal extensions being fixedly inserted into said end portions of said frame, and said vertical extension being fixedly inserted into said upper end of said shaft, thereby to internally connect said frame to said shaft; and fiber reinforced plastic layers coating the outer surface of said end portions of said frame and said upper end of said shaft to provide an external connection therebetween, said fiber reinforced plastic layers placed over said end portions of said frame resulting in a structure whose dimensions are substantially the same as said remaining portion of said frame so as to reduce air resistance.

2. A badminton racket as claimed in claim 1, wherein said vertical extension of said joint is inserted into said upper end of said shaft through said recesses, and an upper edge of said shaft substantially abuts the lower surfaces of said end portions of said frame.

3. A badminton racket as claimed in claim 1, wherein an upper edge of said shaft is fitted in said recesses and substantially abuts on said horizontal extensions of said joint.

4. A badminton racket as claimed in claim 1, wherein said frame includes an inner core, said end portions extend beyond said inner core, and said horizontal extensions of said joint are substantially in contact with end faces of said inner core.

5. A badminton racket as claimed in claim 1, wherein said joint is formed in a solid state.

6. A badminton racket as claimed in claim 5, wherein said joint is made of aluminum.

7. A badminton racket as claimed in claim 5, wherein said joint is formed of fiber reinforced plastic material.

* * * * *